US009051677B2

(12) United States Patent
Seo et al.

(10) Patent No.: US 9,051,677 B2
(45) Date of Patent: Jun. 9, 2015

(54) WASHING MACHINE

(71) Applicant: SAMSUNG ELECTRONICS CO., LTD., Suwon-si (KR)

(72) Inventors: Dong Pil Seo, Suwon-si (KR); Sang Yeon Pyo, Suwon-si (KR); Jae Ryong Park, Hwaseong-si (KR); Byoung Yull Yang, Hwaseong-si (KR); Hwang Mook Cho, Suwon-si (KR); Tai Eun Kim, Suwon-si (KR); So Jung Yu, Suwon-si (KR); Bo Kyung Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/034,741

(22) Filed: Sep. 24, 2013

(65) Prior Publication Data

US 2014/0020433 A1 Jan. 23, 2014

Related U.S. Application Data

(63) Continuation of application No. 12/588,048, filed on Oct. 1, 2009, now Pat. No. 8,627,690.

(30) Foreign Application Priority Data

Nov. 26, 2008 (KR) ..... 10-2008-0118118

(51) Int. Cl.

| | |
|---|---|
| ***D06F 29/00*** | (2006.01) |
| ***D06F 35/00*** | (2006.01) |
| ***D06F 37/12*** | (2006.01) |
| ***D06F 39/08*** | (2006.01) |

(52) U.S. Cl.

CPC ..... *D06F 37/12* (2013.01); *D06F 39/08* (2013.01)

(58) Field of Classification Search

None

See application file for complete search history.

(56) References Cited

U.S. PATENT DOCUMENTS

| | | | | |
|---|---|---|---|---|
| 4,809,524 | A * | 3/1989 | Sickert et al. | 68/148 |
| 6,185,774 | B1 | 2/2001 | Tubman | |
| 2005/0028564 | A1 | 2/2005 | Lee et al. | |

FOREIGN PATENT DOCUMENTS

| | | |
|---|---|---|
| KR | 10-2001-0063438 | 4/2003 |
| KR | 10-2003-0031346 | 4/2003 |

OTHER PUBLICATIONS

U.S. Office Action mailed Oct. 5, 2012 in related U.S. Appl. No. 12/588,048.

U.S. Office Action mailed Jan. 18, 2013 in related U.S. Appl. No. 12/588,048.

U.S. Notice of Allowance mailed Jun. 13, 2013 in related U.S. Appl. No. 12/588,048.

http://www.automaticwasher.org/cgi-bin/TD/TD-VIEWTHREAD.cgi?12227 Post# 215289, and Post#215290.

* cited by examiner

*Primary Examiner* — Jason Ko

(74) *Attorney, Agent, or Firm* — Staas & Halsey LLP

(57) ABSTRACT

A washing machine capable of reducing the manufacturing cost of a circulation device installed to circulate water and capable of preventing water from being scattered when spraying circulating water into a spin basket is described. A tub cover of the washing machine includes a guide part provided with a connector, which is integrated with the tub cover, connected with a circulation passage, and inclined upward toward the tub cover, and an inclined surface inclined toward the spin basket at an inner edge of the tub cover, thereby reducing the manufacturing of the circulation device and preventing water from being scattered. The washing machine includes a circulation drain port formed at a side surface of a tub and a filtering duct connected with the circulation drain port, thereby reducing the manufacturing cost of the circulation device.

12 Claims, 5 Drawing Sheets

WASHING MACHINE

CROSS-REFERENCE TO RELATED APPLICATIONS

This application is a continuation of U.S. application Ser. No. 12/588,048, filed Oct. 1, 2009, which claims the benefit of Korean Patent Application No. 10-2008-0118118, filed on Nov. 26, 2008, in the Korean Intellectual Property Office, the disclosures of which are incorporated herein by reference.

BACKGROUND

1. Field

The present disclosure relates to a washing machine. More particularly, the disclosure relates to a washing machine capable of reducing the amount of water to be used and power consumption by circulating the water.

2. Description of the Related Art

In general, a washing machine washes laundry by repeating a stroke of washing, rinsing, and drying. The washing machine includes a cabinet, a tub, a spin basket, and a water supply device. The cabinet forms an outer appearance of the washing machine. The tub is installed in the cabinet to store water therein. The spin basket is rotatably installed in the tub and has a pulsator installed therein. The water supply device supplies the water to the tub.

Since the washing machine operates in a state in which water is filled in the tub and the spin basket, the amount of water and detergent used in washing is increased, and time for feeding and draining water is increased, so that the total washing time is increased.

Therefore, in order to address the above problem, a washing machine capable of circulating water has been suggested. In detail, the washing machine circulates water during the washing or rinsing process to supply the water into the spin basket again. According to the above scheme, the washing machine can wash the laundry even if less water is supplied to the tub and the spin basket and the above problem may be solved.

However, the washing machine employing such a water circulation scheme needs an additional nozzle to spray water from the tub into the spin basket while circulating the the tub water, and needs an additional filter to remove foreign matters contained in the water being circulated.

In addition, if the above washing machine sprays the water using the nozzle while circulating the water, the water may not be smoothly sprayed into the spin basket, but scattered.

SUMMARY

Accordingly, it is an aspect of the disclosure to provide a washing machine capable of reducing the manufacturing cost of a circulation device used to circulate water.

It is another aspect of the disclosure to provide a washing machine capable of preventing water from being scattered when spraying circulating water into a spin basket.

Additional aspects and/or advantages of the disclosure will be set forth in part in the description which follows and, in part, will be apparent from the description, or may be learned by practice of the disclosure.

The foregoing and/or other aspects of the disclosure are achieved by providing a washing machine including a cabinet, a tub installed in the cabinet, a spin basket rotatably installed in the tub, a tub cover provided at an upper portion of the tub, and a circulation passage guiding water contained in the tub such that the water of the tub is circulated to the spin basket.

According to an aspect, the tub cover is integrated with a connector connected with the circulation passage.

According to an aspect, the connector is formed at an outer edge of the tub cover, and inclined upward toward a bottom surface of the tub cover.

According to an aspect, the connector is inclined at an angle of 40° to 60° about the tub cover.

According to an aspect, the tub cover is provided at an inner edge thereof with an inclined surface that is inclined downward toward an inside of the spin basket.

According to an aspect, the inclined surface is inclined at an angle of about 50° to about 85° about a bottom surface of the tub cover.

According to an aspect, the tub cover is provided at a bottom surface thereof with a water speed reducing protrusion to reduce a speed of water introduced through the connector.

According to an aspect, a guide rib protrudes from a bottom surface of the tub cover to widely spread water introduced through the connector.

According to an aspect, the tub is formed with a circulation drain port allowing the water of the tub to be drained or circulated, According to an aspect, the circulation drain port is formed at a side surface of the tub spaced apart from a bottom surface of the tub.

According to an aspect, the tub includes a filtering duct having one end communicating with the circulation drain port to filter water that has been drained through the circulation drain port, and a remaining end connected with the circulation passage.

According to an aspect, the filtering duct includes an internal passage having a U shape.

According to an aspect, the circulation passage is connected with an upper portion of the internal passage having a U shape.

According to an aspect, the washing machine further includes a drain passage connected with the filtering duct, and a drain pump mounted in the drain passage, such that the water contained in the tub is drained.

According to an aspect, the drain passage is connected with a lower portion of the U-shaped internal passage of the filtering duct.

According to an aspect, a circulation pump is mounted in the circulation passage to pump the water contained in the tub.

It is another aspect of the disclosure to provide a washing machine including a cabinet, a tub installed in the cabinet, a spin basket rotatably installed in the tub, a tub cover provided at an upper portion of the tub, and a circulation passage guiding water contained in the tub such that the water is circulated, in which the tub cover includes a guide part guiding the water guided along the circulation passage to the spin basket.

According to another aspect, the guide part includes a connector integrated with the tub cover at an outer edge of the tub cover, inclined upward toward the tub cover, and connected with the circulation passage, and an inclined surface inclined downward toward the spin basket at an inner edge of the tub cover.

According to another aspect, the guide part further includes a water speed reducing protrusion formed on a bottom surface of the tub cover.

According to another aspect, a guide rib protrudes from a bottom surface of the tub cover to widely spread water introduced through the connector.

According to another aspect, the tub is formed with a circulation drain port allowing the water of the tub to be drained or circulated, and the circulation drain port is formed at a side surface of the tub spaced apart from a bottom surface of the tub.

According to another aspect, the tub includes a filtering duct, which is formed with an internal passage having a U shape and has one end connected with the circulation drain port and a remaining end connected with the circulation passage.

It is still another aspect of the disclosure to provide a washing machine including a cabinet, a tub installed in the cabinet, a spin basket rotatably installed in the tub, a tub cover provided at an upper portion of the tub, a filtering duct installed on an outer surface of the tub to allow water contained in the tub to be filtered when the water is circulated, a circulation passage connected with the filtering duct such that the water contained in the tub to be guided, and a connector integrated with the tub cover and connected with the circulation passage.

According to still another aspect, a circulation drain port is formed at a side surface of the tub spaced apart from a bottom surface of the tub, and the filtering duct includes an internal passage having a U shape and has one end connected with the circulation drain port and a remaining end connected with the circulation passage.

As described above, in contrast with a conventional washing machine needing an additional nozzle, the washing machine according to an embodiment can spray water that has been circulated through the tub cover into the spin basket, thereby allowing the manufacturing cost of the washing machine to be reduced and preventing water from being scattered when the water is sprayed.

In addition, since the washing machine according to an embodiment can filter foreign matters contained in the water by using the circulation drain port and the filtering duct, an additional filter need not be installed, thereby reducing manufacturing costs.

BRIEF DESCRIPTION OF THE DRAWINGS

These and/or other aspects and advantages of the disclosure will become apparent and more readily appreciated from the following description of the embodiments, taken in conjunction with the accompanying drawings of which.

DETAILED DESCRIPTION

Figure 1:
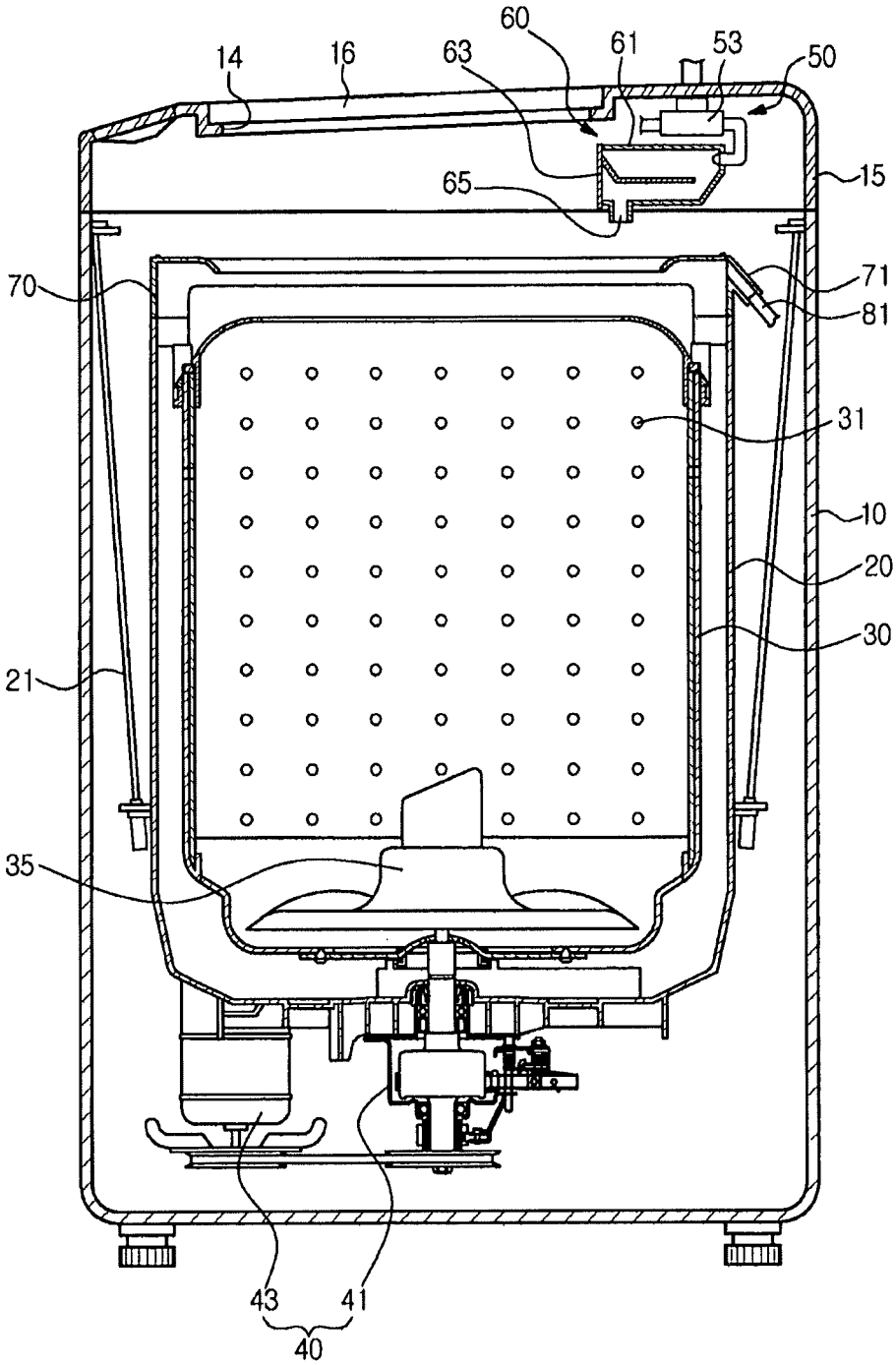
FIG. 1 is a sectional view showing a washing machine according to an embodiment.

Reference will now be made in detail to embodiments, examples of which are illustrated in the accompanying drawings, wherein like reference numerals refer to the like elements throughout. Embodiments are described below to explain the disclosure by referring to the figures.

Figure 2:
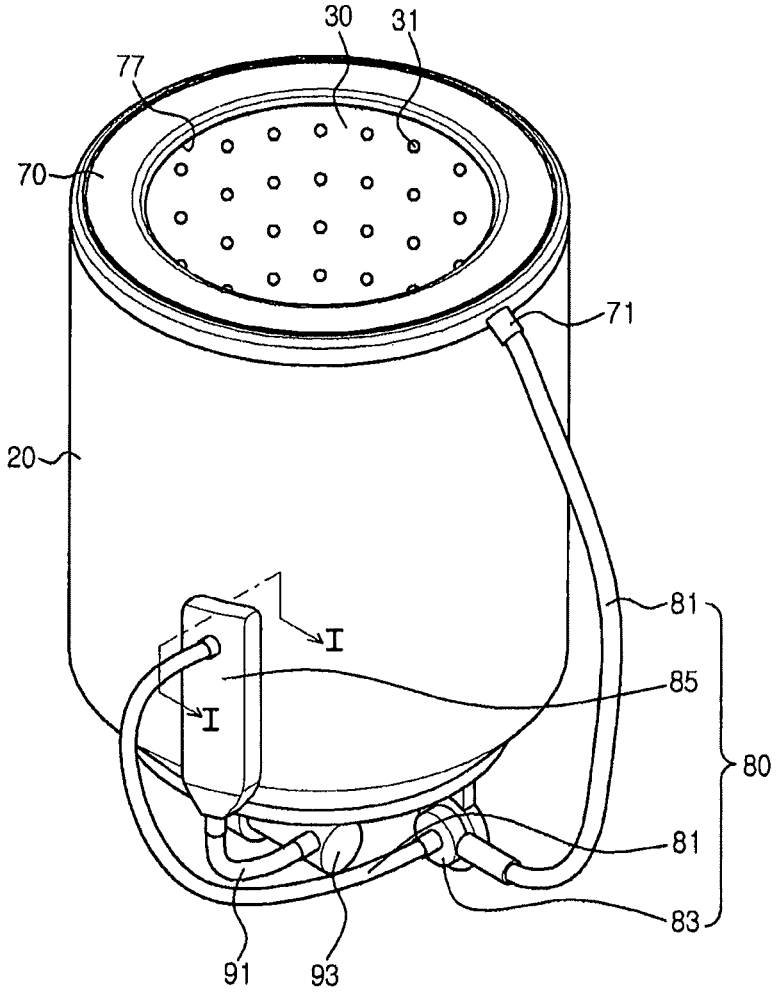
FIG. 2 is a perspective view showing a portion of the washing machine of FIG. 1.

As shown in FIGS. 1 and 2, a washing machine according to an embodiment may include, for example, a cabinet 10, a tub 20, a spin basket 30, and a driving device 40. The cabinet 10 forms an outer appearance. The tub 20 is installed in the cabinet 10. The spin basket 30 is rotatably installed in the tub 20. The driving device 40 is installed at a lower portion of the tub 20 in order to rotate the spin basket 30.

The cabinet 10 is provided at an upper portion thereof with a cover 15 having a laundry inlet 14 allowing a user to input laundry into the spin basket 30 or to take the laundry out of the spin basket 30. A door 16 is foldably coupled with the cover 15 to open/close the laundry inlet 14.

The tub 20 is installed inside the cabinet 10 to receive water. A suspension device 21 is coupled with an outer surface of the tub 20 to suspend the tub 20 from the cabinet 10 while supporting the tub 20. A tub cover 70 is provided at an upper end of the tub 20 to cover the tub 20 in the shape of a circle.

The spin basket 30 is rotatably installed in the tub 20. The spin basket 30 includes a plurality of through holes 31 such that an internal space of the spin basket 30 communicates with an internal space of the tub 20.

A pulsator 35 is rotatably mounted on a bottom surface of the spin basket 30 to stir laundry put into the spin basket 30 into water.

The driving device 40 includes a clutch 41 to rotate the spin basket 30 and the pulsator 35 and a driving motor 43 to drive the clutch 41. In this case, the driving motor 43 is coupled with the clutch 41 through a belt and a pulley to transfer driving force to the clutch 41.

The washing machine further includes a water supply device 50, a detergent supply device 60, and a circulation device 80. The water supply device 50 supplies water. The detergent supply device 60 dissolves detergent in water while the water is supplied. The circulation device 80 sprays water of the tub 20 into the spin basket 30 again by circulating the water of the tub 20.

The water supply device 50 is installed at one side of the cover 15. The water supply device 50 includes a water supply valve 53 controlling the supply of water and a water supply pipe (not shown) connecting the water supply valve 53 with the detergent supply device 60.

The detergent supply device 60 includes a case 61 provided inside the cover 15 and a detergent vessel 63 detachably installed in the case 61 to contain detergent. The case 61 is provided at a bottom surface thereof with a discharge port 65 to discharge water into which detergent is dissolved.

Figure 3:
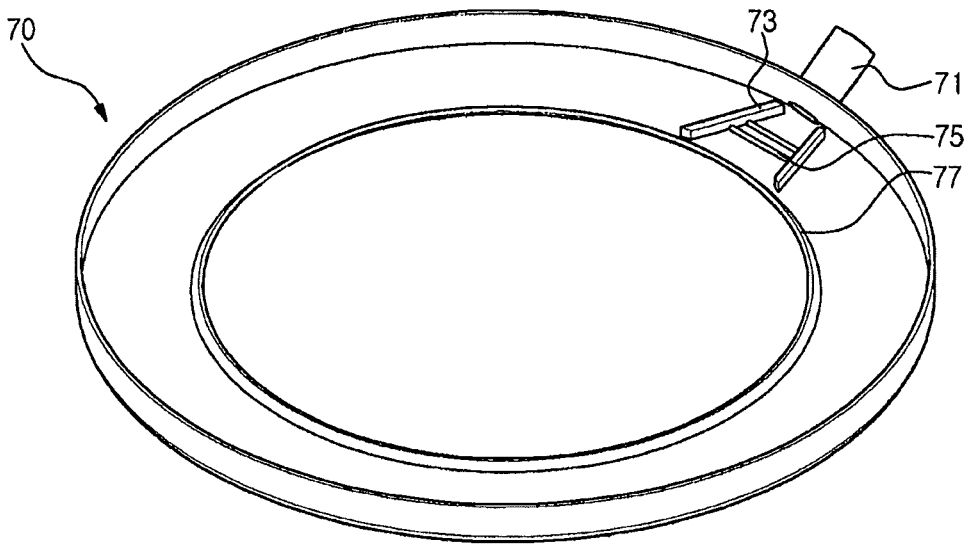
FIG. 3 is a perspective view showing a tub cover of FIG. 2.
Figure 4:
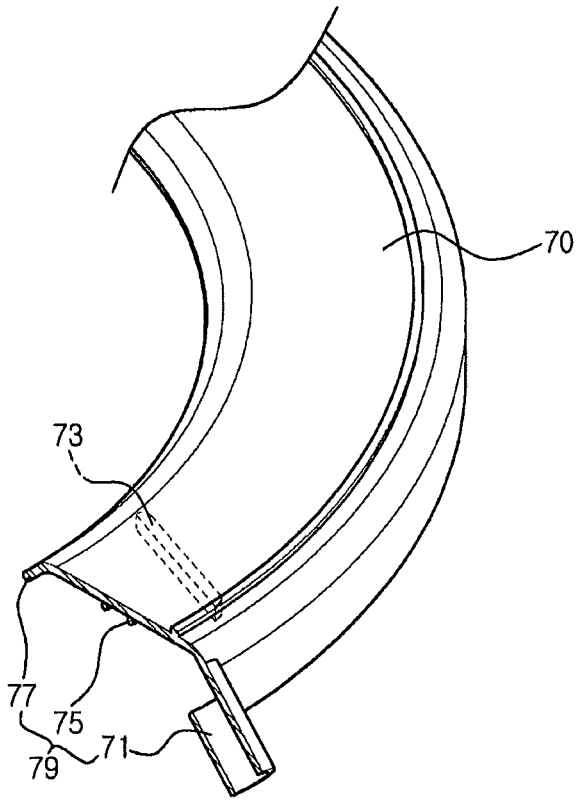
FIG. 4 is a perspective view showing a part of the tub cover of FIG. 3.

As shown in FIGS. 2 to 4, the circulation device 80 includes a circulation passage 81 and the tub cover 70. The circulation passage 81 guides the water of the tub 20 such that the water can be re-circulated to the spin basket 30 through the circulation passage 81. The tub cover 70 is connected with the circulation passage 81 to spray water guided along the circulation passage 81 into the spin basket 30.

In order to allow the water of the tub 20 to be circulated through the circulation passage 81 as described above, a circulation pump 83 is mounted in the circulation passage 81.

A connector 71 is provided at one side of an outer surface of the tub cover 70 and is connected with the circulation passage 81. The connector 71 is integrated with the tub cover 70, and may be inclined upward toward a bottom surface of the tub cover 70. The connector 71 may be integrally formed with the tub cover 70 as a single piece, for example, by injection molding. Alternatively, the connector 71 may be integrated with the tub cover 70 as separate pieces, for example, by screw connection. In an embodiment, the connector 71 is preferably inclined at an angle of about 40° to about 60° with respect to the bottom surface of the tub cover 70 in order to prevent water introduced through the connector 71 from being scattered.

A pair of guide ribs 73 protrudes from the bottom surface of the tub cover 70 to diffusely spread water introduced through the connector 71. The guide ribs 73 are symmetrical to each other about the connector 71 on the bottom surface of the tub cover 70. In order to diffusely spread the water introduced through the connector 71, the interval of the guide ribs 73 is gradually widened from an outer edge of the tub cover 70 to an inner edge thereof.

At least one protrusion 75 is formed between the guide ribs 73. The water stream introduced through the connector 71 collides with the protrusion 75, thereby reducing the speed of the water. As shown in the drawings, the protrusion 75 may be formed in a circumferential direction of the tub cover 70 in the form of a protuberance.

An inclined surface 77 is provided at an inner edge of the tub cover 70 to spray water, which has been introduced through the connector 71 and which is spread by each guide rib 73 into the spin basket 30. In an embodiment, the inclined surface 77 is preferably inclined at an angle of from 50° to 85° with respect to the bottom surface of the tub cover 70 in order to prevent water from being scattered together with the connector 71 inclined at a predetermined angle.

The tub cover 70, according to an embodiment, includes a guide device 79. The guide device 79 may include, for example, the connector 71 connected with the circulation passage 81 and inclined at a predetermined angle, the protrusion 75 reducing the speed of water introduced through the connector 71, and the inclined surface 77 inclined at a predetermined angle and guiding the water introduced through the connector 71 to spray the water into the spin basket 30. Such a guide device 79 prevents water introduced into the tub cover 70 from being scattered when the water is sprayed into the spin basket 30.

Figure 5:
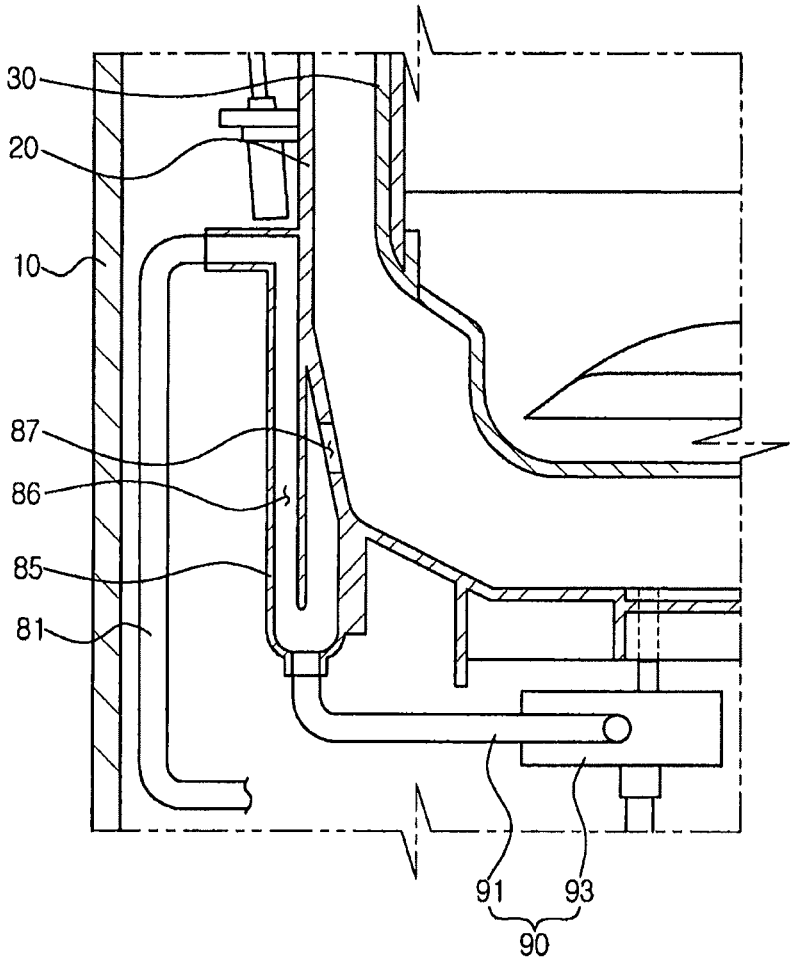
FIG. 5 is a sectional view taken along line I-I of FIG. 2.

As shown in FIGS. 2 and 5, the circulation device 80 further includes a filtering duct 85 used to filter water when the water is circulated in the tub 20.

The filtering duct 85 has one end connected with a circulation drain port 87 formed in the tub 20 and the other end connected with the circulation passage 81. The circulation drain port 87 is formed at a side surface of the tub 20 spaced apart from the bottom surface of the tub 20 by a predetermined distance so that foreign matter, for example a coin having a predetermined size, contained in the water is filtered when the water is circulated.

The filtering duct 85 has an internal passage 86 having a U shape in order to filter foreign matters such as a fluff that has not been filtered through the circulation drain port 87. In the filtering duct 85, one end of the internal passage 86 having a U shape is connected with the circulation drain port 87 and the other end of the internal passage 86 is connected with the circulation passage 81.

In addition, the washing machine further includes a drain device 90 to drain water out of the tub 20. As shown in FIG. 5, the drain device 90 may include, for example, a drain passage 91 connected with the filtering duct 85 to guide the drain of the water, and a drain pump 93 mounted in the drain passage 91. As shown in FIG. 5, the drain passage 91 is connected with the internal passage 86 of the filtering duct 85. The drain device 90 drains the water out of the tub 20 as described above, and discharges foreign matters, which have been piled on the filtering duct 85 when the water is circulated, through the drain passage 91.

Hereinafter, a process of circulating water in the washing machine according to an embodiment will be described.

First, the circulation pump 83 mounted in the circulation passage 81 is operated in order to circulate water contained in the tub 20. If the circulation pump 83 is operated, the water is discharged through the circulation drain port 87 formed on the side surface of the tub 20 and then moved to the circulation passage 81 through the filtering duct 85. When the water of the tub 20 is moved to the circulation passage 81 as described above, foreign matters contained in the water are filtered through the circulation drain port 87 and the filtering duct 85.

In other words, according to an embodiment, since foreign matters contained in water can be filtered through the circulation drain port 87 and the filtering duct 85 without necessarily requiring an additional filter, the manufacturing cost potentially incurred due to the additional filter can be eliminated.

Thereafter, the water moved into the circulation passage 81 is introduced into the connector 71 of the tub cover 70 along the circulation passage 81. The water introduced through the connector 71 is sprayed into the spin basket 30 through the bottom surface of the tub cover 70 and the inclined surface 77.

In this case, according to an embodiment, the water moved into the circulation passage 81 is sprayed into the spin basket 33 through the connector 71 and the inclined surface 77 provided in the tub cover 70 as described above, so that an additional nozzle is unnecessary. Accordingly, the manufacturing cost can be reduced.

In addition, according to an embodiment, the water is sprayed into the spin basket 30 using the connector 71 and the inclined surface 77, both of which are inclined at a predetermined angle in the tub cover 70. Accordingly, the water is prevented from being scattered.

Although few embodiments have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet;

a tub installed in the cabinet;

a tub cover provided at an upper portion of the tub and having a substantially circular opening for receiving laundry, the opening being defined by an inner rim provided at an inner circumference of the tub cover;

a spin basket rotatably installed in the tub and having a basket opening located to correspond with the substantially circular opening of the tub cover;

a circulation pump arranged to circulate water contained in the tub;

a circulation passage member arranged to guide water discharged from the circulation pump; and a connector that is connected to the circulation passage member and that is inclined upward toward the tub cover, wherein the water introduced through the connector is guided by the tub cover and supplied into the spin basket through the basket opening;

wherein the tub cover has a hole formed therethrough such that the connector communicates with the hole, and the tub cover is integrally formed as a single piece with the connector.

2. The washing machine of claim 1, wherein the connector is inclined at an angle of about 40° to about 60° with respect to a surface of the tub cover.

3. The washing machine of claim 1, wherein the tub is formed with a circulation drain port to allow the water in the tub to be at least one of drained and circulated, and the circulation drain port is formed at a side surface of the tub spaced apart from a bottom surface of the tub.

4. The washing machine of claim 1, wherein the circulation pump is connected to the circulation passage member to pump the water contained in the tub.

5. The washing machine of claim 1, wherein the tub cover and the connector are injection molded as the single piece.

6. The washing machine of claim 1, wherein the connector comprises a connecting end integrally formed as the single piece with the tub cover and a distal end, and the connecting end of the connector is inclined with respect to the distal end of the connector.

7. The washing machine of claim 6, wherein the connector is cylindrically shaped.

8. The washing machine of claim 1, wherein the circulation passage member comprises a hose that connects to the connector.

9. The washing machine of claim 1, wherein a guide is formed between an outer rim of the tub cover and the inner rim of the tub cover to guide the water from the connector directly into the spin basket through the basket opening.

10. A washing machine comprising:

a cabinet;

a tub installed in the cabinet;

a tub cover provided at an upper portion of the tub and having an opening for receiving laundry, the opening defined by an inner rim provided at an inner circumference of the tub cover;

a spin basket rotatably installed in the tub and having a basket opening located to correspond with the opening of the tub cover;

a circulation pump arranged to circulate water contained in the tub;

a circulation passage member arranged to guide water discharged from the circulation pump; and a connector, inclined upward toward the tub cover, integrally formed as a single piece with the tub cover, and connected to the circulation passage member, wherein a guide is formed to guide the water from the connector directly into the spin basket through the basket opening.

11. The washing machine of claim 10, wherein the tub cover has a hole formed therethrough such that the connector communicates with the hole and a width of the guide formed in the tub cover becomes progressively larger towards the inner rim of the tub cover from the hole.

12. The washing machine of claim 10, wherein the guide is formed between an outer rim of the tub cover and the inner rim of the tub cover.

* * * * *